US011226086B2

(12) United States Patent
Chen et al.

(10) Patent No.: US 11,226,086 B2
(45) Date of Patent: Jan. 18, 2022

(54) ASSEMBLED ANNULAR LIGHT SUPPLEMENT LAMP

(71) Applicant: Shenzhen wei bo technology co., LTD, Shenzhen (CN)

(72) Inventors: Wei Chen, Shenzhen (CN); Jianghua Chen, Shenzhen (CN)

(73) Assignee: Shenzhen wei bo technology co., LTD, Shenzhen (CN)

( * ) Notice: Subject to any disclaimer, the term of this patent is extended or adjusted under 35 U.S.C. 154(b) by 0 days.

(21) Appl. No.: 17/351,268

(22) Filed: Jun. 18, 2021

(65) Prior Publication Data

US 2021/0310639 A1 Oct. 7, 2021

(51) Int. Cl.

| | |
|---|---|
| ***F21V 17/16*** | (2006.01) |
| ***F21V 23/06*** | (2006.01) |
| ***F21V 23/00*** | (2015.01) |

(52) U.S. Cl.

CPC ..... *F21V 17/16* (2013.01); *F21V 23/003* (2013.01); *F21V 23/06* (2013.01)

(58) Field of Classification Search

CPC ..... F21V 17/16; F21V 23/06; F21V 23/003
See application file for complete search history.

(56) References Cited

U.S. PATENT DOCUMENTS

| | | | | |
|---|---|---|---|---|
| 2007/0165401 | A1 | 7/2007 | Lin | |
| 2010/0142215 | A1* | 6/2010 | Waring | B60Q 1/2696 362/473 |
| 2014/0301068 | A1 | 10/2014 | Wu | |
| 2015/0192277 | A1 | 7/2015 | Yu | |
| 2018/0224106 | A1* | 8/2018 | Wang | F21V 5/002 |
| 2019/0268518 | A1* | 8/2019 | Howard | F21V 17/105 |
| 2020/0326045 | A1* | 10/2020 | Qiao | F21V 17/12 |

* cited by examiner

*Primary Examiner* — Evan P Dzierzynski

(57) ABSTRACT

The present invention relates to an assembled annular light supplement lamp, including a first splicer and a second splicer that are spliced to form a ring, where both ends of the first splicer and the second splicer are provided with a first end face and a second end face respectively, and the first end face is in plug-in connection with the adjacent second end face. By arranging the first splicer and the second splicer, where one or a plurality of second splicers may be provided, splicing or disengagement is realized by the matching between a first guide pin and a first slot, so that the assembled annular light supplement lamp is easy to install and use, and reduces the storage space and transportation costs after disassembly.

10 Claims, 4 Drawing Sheets

ASSEMBLED ANNULAR LIGHT SUPPLEMENT LAMP

TECHNICAL FIELD

The present invention relates to the technical field of annular light supplement lamps, and in particular, to an assembled annular light supplement lamp.

BACKGROUND

With the rise of the field of live broadcast, light supplement lamps are often used for auxiliary light supplement and lighting to improve the effects of photography, video recording or live broadcast.

Most of commercially available annular light supplement lamps have an integrated annular structure, and products in such form have the disadvantages of large size, large occupied space, high transportation costs and inconvenience to carry.

SUMMARY

To solve the problem of large occupied space of annular light supplement lamps, the present invention provides an assembled annular light supplement lamp.

The technical solution for solving the technical problem in the present invention is: to provide an assembled annular light supplement lamp, including a first splicer and a second splicer that are spliced to form a ring, and a fixed seat connected to the first, splicer, where the first splicer is provided with a first lamp panel and a mounting groove, and a power supply component and a control component that are electrically connected to the first lamp panel are arranged, in the mounting groove; the second splicer is provided with a second lamp panel; both ends of the first splicer and the second splicer are provided with a first end face and a second end face respectively, and the first end face is in plug-in connection with the adjacent second end face.

In one embodiment, the first end face is provided with a convex step on which a first guide pin and a first contact spring are arranged, the second end face is provided with a groove matched with the convex step, and the groove is provided with a first slot in close fit with the first guide pin and a second contact spring; the first contact spring and the second contact spring are electrically connected to the corresponding lamp panels respectively, and the first guide pin is inserted into the first slot to connect the first contact spring and the second contact spring.

In one embodiment, the first end face is further provided with a snap, and the second end face is provided with a snap joint matched with the snap.

In one embodiment, the first end face is farther provided with a first flange on the side away from the snap, and the second end face is provided with an avoidance groove matched with the flange on the side away from the snap joint.

In one embodiment, the first splicer includes a first base plate and a first cover plate, where the first lamp panel is arranged in a first cavity formed by the first base plate and the first cover plate, and the first contact spring is connected to the first lamp panel through a spring press block: and the first mounting groove is connected to the first base plate.

In one embodiment, the first mounting groove includes a mounting cavity wall integrally arranged with the first base plate and a rear cover plate connected to the mounting cavity wall, where the upper end of the mounting cavity wall is provided with a second slot, and the upper end of the rear cover plate is correspondingly provided with a second guide pin matched with the second slot.

In one embodiment, the first guide pin includes a column and ribs arranged on both sides of the column, where the width of the ribs is smaller than the diameter of the column.

In one embodiment, one or a plurality of second splicers are provided.

In one embodiment, the second splicer includes a second base plate and a second cover plate, where the second lamp panel is arranged in a second cavity formed by the second base plate and the second cover plate, several air vents recessed toward one side of the second cavity are arranged on the second base plate, and side walls of the air vents are provided with through holes to communicate with the second cavity.

In one embodiment, a rotary seat for adjusting the angle of the fixed seat is removably connected to the fixed seat, where the rotary seat is locked with the fixed seat through a first locking member, a sleeve is arranged at the other end of the rotary seat, and a second locking member for limiting the sleeve is arranged on the rotary seat.

ADVANTAGEOUS EFFECTS

By arranging the first splicer and the second splicer, where one or a plurality of second splicers may be provided, splicing or disengagement is realized by the matching between a first guide pin and a first slot, and the annular light supplement lamp is formed by plug-in connection between the first splicer and the second splicer, so that the assembled annular light supplement lamp according to the present invention is easy to install and use, and reduces the storage space and transportation costs after disassembly.

BRIEF DESCRIPTION OF DRAWINGS

The present invention will be further described with reference to accompanying drawings and embodiments, in which.

Figure 1:
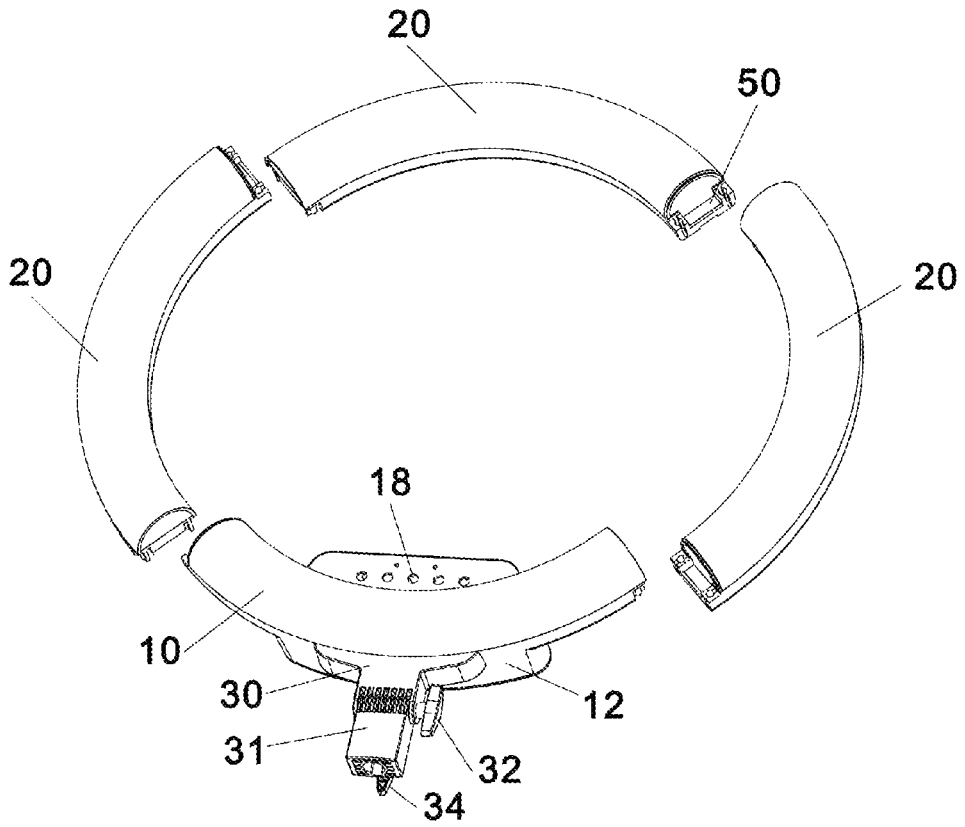
FIG. 1 is a schematic exploded diagram of an assembled annular light supplement lamp according to an embodiment of the present invention.

Reference numerals in the figures: first splicer 10; first lamp panel 11; mounting groove 12; mounting cavity wall 121; rear cover plate 122; second slot 123; second guide pin 124; first base plate 13; first cover plate 14; spring press block 15; first cavity 16; power supply component 17; control component 18; USB interface 19; second splicer 20; second lamp panel 21; second base plate 22; second cover plate 23; second cavity 24; air vents 25; fixed seat 30; rotary seat 31; first locking member 32; sleeve 33; second locking member 34; first end face 40; convex step 41; first guide pin 42; column 421; ribs 422; first contact spring 43; snap 44; first flange 45; second end face 50; groove 51; first slot 52; second contact spring 53; snap joint 54; avoidance groove 55.

DESCRIPTION OF EMBODIMENTS

The preferred embodiments of the present invention are now described in, detail with reference to accompanying drawings.

Figure 2:
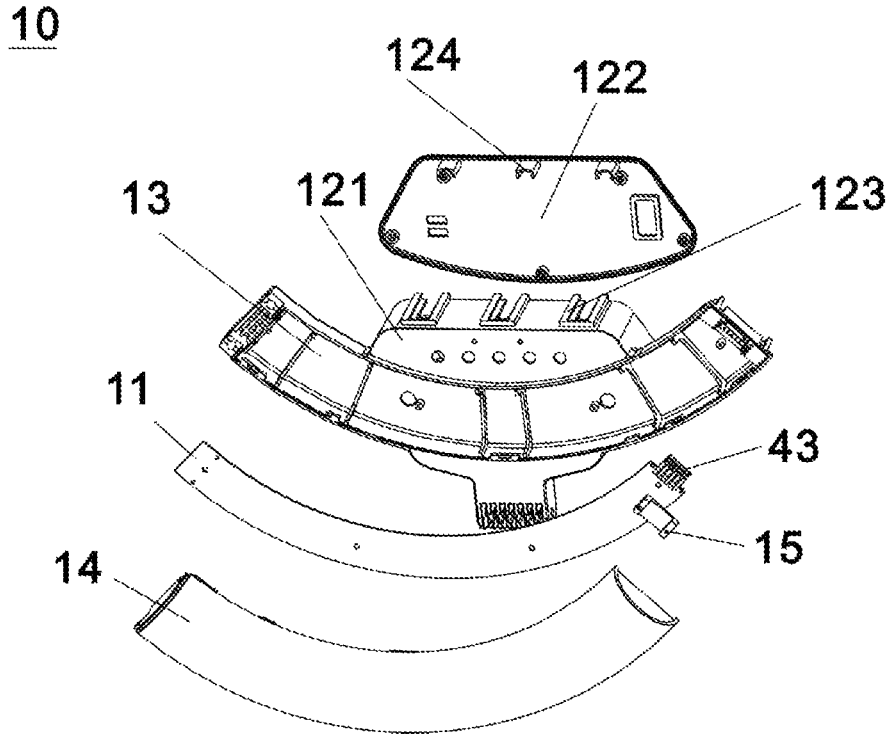
FIG. 2 is a schematic exploded structural diagram of a first splicer according to the present invention.
Figure 3:
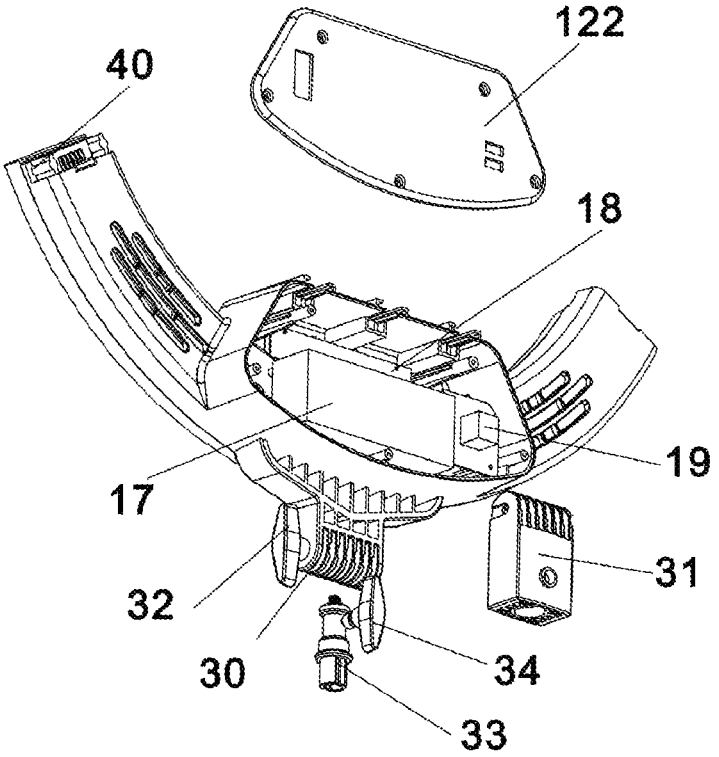
FIG. 3 is a schematic exploded structural diagram of the first splicer according to the present invention from another angle.
Figure 4:
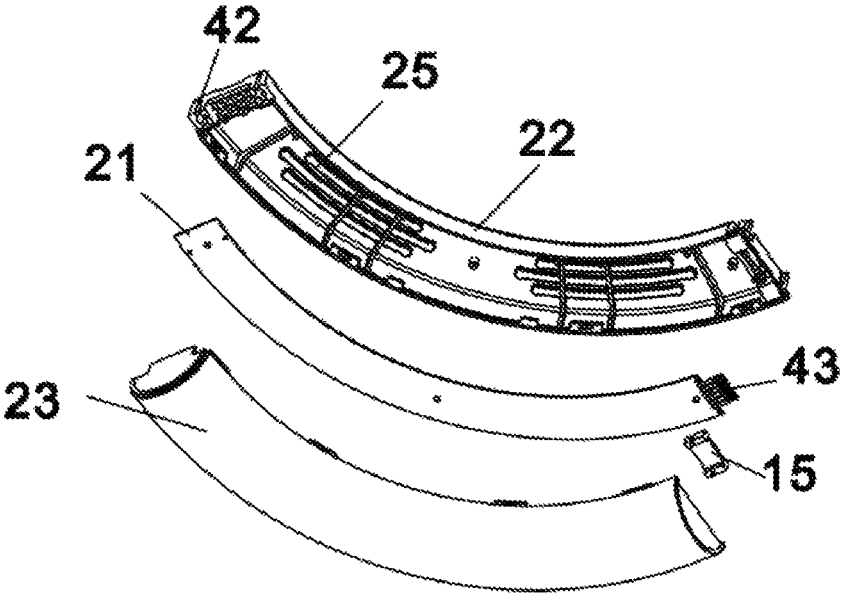
FIG. 4 is a schematic exploded structural diagram of a second splicer according to the present invention.
Figure 5:
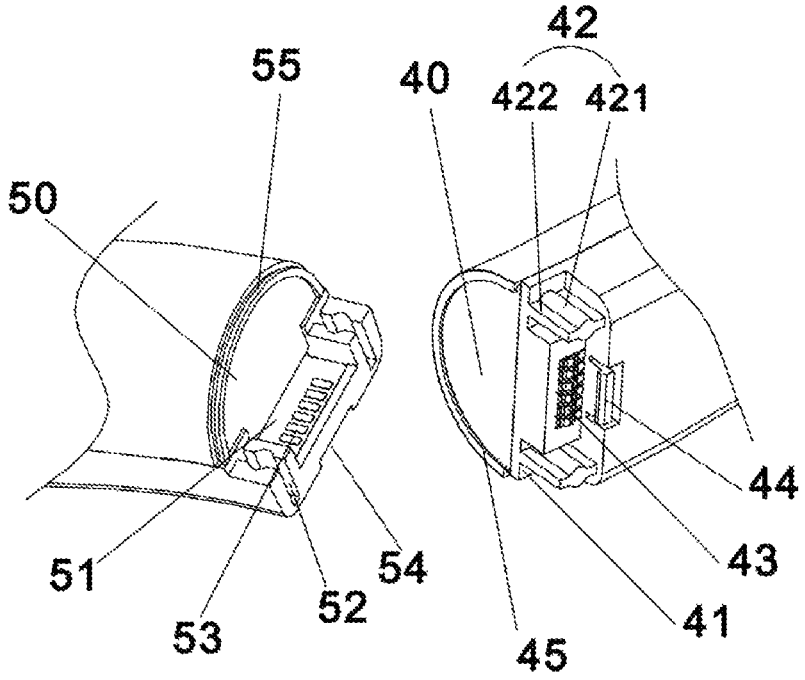
FIG. 5 is a schematic structural diagram of a first end face and a second end face according to the present invention.
Figure 6:
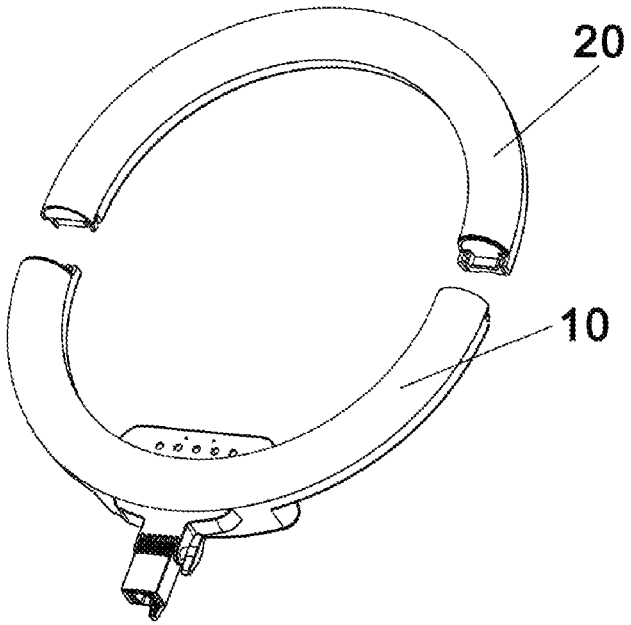
FIG. 6 is a schematic exploded diagram of an assembled annular light supplement lamp according, to another embodiment of the present invention.
Figure 7:
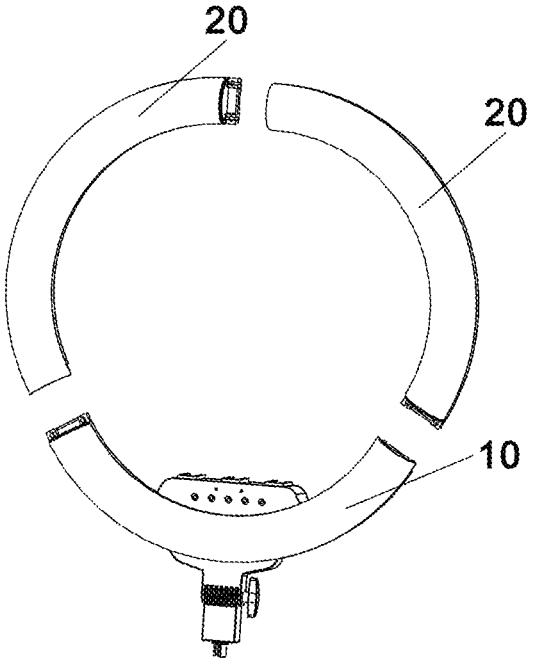
FIG. 7 is a schematic exploded diagram of an assembled annular light supplement lamp according to still another embodiment of the present invention.

With reference to FIGS. 1-7, the present invention provides an assembled annular light supplement lamp, including a first splicer 10 and a second splicer 20 that are spliced to form a ring, and a fixed seat 30 connected to the first splicer 10, where the fixed seat 30 is used for connecting a support rod for live broadcast or photographing, and the first splicer 10 and the second splicer 20 can be spliced to form a ring, so that the assembled annular light supplement lamp reduces, an occupied space after disassembly and is easy to carry and transport.

Specifically, the first splicer 10 is provided with a first, lamp panel 11 and a mounting groove 12, and includes a first base plate 13 and a first cover plate 14, where the first lamp panel 11 is arranged in a first cavity formed by the first base plate 13 and the first cover plate 14, and the first cover plate 14 is removably snapped onto the first base plate 13. The second splicer 20 includes a second base plate 22 and a second cover plate 23, where the second lamp panel 21 is arranged in a second cavity formed by the second base plate 22 and the second cover plate 23, and the second cover plate 23 is removably snapped onto the second base plate 22. The first lamp panel 11 and the second lamp panel 21 are respectively provided with corresponding PCBs and lamp beads.

Both ends of the first splicer 10 and the second splicer 20 of the present invention are provided with a first end face 40 and a second end face 50 respectively, and the first end face 40 is in plug-in connection with the second end face 50 to, form a removable splicing structure.

Specifically, the first end face 40 in this embodiment is provided with a convex step 41 on which a first guide pin 42 and a first contact spring 43 are arranged, the second end face 50 is provided with a groove 51 matched with the convex step 41, and the groove 51 is provided with a first slot 52 in close fit with the first guide pin 42 and a second contact spring 53, the first contact spring 43 is electrically connected to the first lamp panel 11, and the second contact spring 53 is electrically connected to the second lamp panel 21. During splicing, the first guide pin 42 is inserted into the first slot 52 to connect the first contact spring 43 and the second contact spring 53 which are, in close fit, thereby implementing the electrical connection between the first splicer 10 and the second splicer 20 or between the second splicers 20. The first guide pin 42 is disengaged from the first slot 52, and the circuit between the splicers is disconnected for disassembly, so as to reduce the occupied space and facilitate portability. In this embodiment, the first guide pin 42 includes a column 421 and ribs 422 arranged on both sides of the column 421, where the width of the ribs 422 is smaller than the diameter of the column 421, the first slot 52 corresponds to the structure of the first guide pin 42, and the first guide pin 42 is inserted into the first slot 52 from the top down to form a close fit to ensure that the structure is compact without looseness and shaking after splicing. In other embodiments, the first end face 40 is in plug-in connection with the second end face 50 in the form of a chute and a lug.

Further, the first end face 40 is further provided with a snap 44, and the second end face 50 is provided with a snap joint 54 matched with the snap 44. When the first guide pin 42 is inserted into the first slot 52, the snap 44 snaps into the corresponding snap joint 54, allowing the integral connection to be more secure and stable. The first end face 40 is further provided with a first flange 4545 on the side away from the snap 44, the second end face 50 is provided with an avoidance groove 55 matched with the first flange 45 on the side away from the snap joint 54, and seamless splicing is formed based on the matching between the first flange 45 and the avoidance groove 55 to ensure the aesthetic appearance of the annular light supplement lamp.

The first contact spring 43 and the second contact spring 53 are respectively provided with a plurality of contact sub-springs to increase the contact area, and the corresponding contact sub-springs are designed as a semicircular arc with contact elasticity. More specifically, the first contact spring 43 and the second contact spring 53 are respectively connected to the first lamp panel 11 and the second lamp panel 21 through the spring press block 15, and the tightness of connection is ensured by the spring press block 15. Several air vents 25 recessed toward one side of the second cavity are arranged on the second base plate 22, and side walls of the air vents 25 are provided with through holes to communicate with the second cavity.

One or a plurality of second splicers 20 may be provided in this embodiment. When one second splicer 20 is provided, both the first splicer 10 and the second splicer 20 are preferably semi-ring shaped to ensure structural stability and size adaptation. When two or more second splicers 20 are provided, the first end face 40 of the second splicer 20 is connected to the adjacent second end face 50 to implement the electrical connection between the second splicers 20 or the connection between the second splicers 20 and the first splicer 10. There are preferably three second splicers 20 which divide the ring equally together with the first splicer 10, so as to reduce the occupied space after disassembly.

The mounting groove 12 is connected to the first base plate 13, and includes a mounting cavity wall 121 and a rear cover plate 122 connected to the mounting cavity wall 121. In this embodiment, the mounting cavity wall 121 is integrally arranged with the first base plate 13. The upper end of the mounting cavity wall 121 is provided with a second slot 123, and the upper end of the rear cover plate 122 is correspondingly provided with a second guide pin 124 matched with the second slot 123, where the second guide pin 124 is tapered, and the tapered front end is inserted into the second slot 123. The matching between the second guide pin 124 and the second slot 123 facilitates the removable connection between the rear cover plate 122 and the mounting cavity wall 121, and facilitates the maintenance or replacement of parts in the mounting groove 12.

Specifically, a power supply component 17 and a control component 18 that are electrically connected to the first lamp panel 11 are arranged in the mounting groove 12, where the power supply component 17 is used for providing power, and the control component 18 is used for controlling the first lamp panel 11 and the second lamp panel 21, including a control board and control buttons connected to the control board, and the corresponding control buttons may include a switch button, a light brightness adjustment button, a light color adjustment button, and the like. Further, the mounting groove 12 is further provided with a USB interface 19 electrically connected to the power supply component 17 for charging the annular light supplement lamp.

The fixed seat 30 is connected to the lower end of the first base plate 13, a rotary seat 31 is rotatably connected to the fixed seat 30, and the angle of the annular light supplement lamp is adjusted by adjusting the connection position between the fixed seat 30 and the rotary seat 31.

Specifically, the lower ends of the rotary seat 31 and the fixed seat 30 in this embodiment have a cross-nested structure, and are locked by a first locking member 32. The cross-nested structure can ensure that the fixed seat 30 and the rotary seat 31 can be rotatably arranged and stably connected to ensure use stability of the device. The first locking member 32 may include a first knob and a locking screw, and one end of the locking screw passes through the fixed seat 30 and the rotary seat 31 and is locked with the first knob.

A sleeve 33 is arranged inside the lower end of the rotary seat 31, and can be sleeved on a support component to fix the annular light supplement lamp. To ensure stable connection with the support component, the rotary seat 31 is further provided with a second locking member 34 for limiting the sleeve 33, the support component is sleeved on the sleeve 33, and the second locking member 34 passes through the sleeve 33 and locks the support component.

It should be noted that the terms "vertical" "horizontal", "coaxial", "left" and other similar expressions used herein are for the purpose of illustration only and do not represent, the unique implementation.

The technical features in the above-mentioned embodiments can be combined in any way. For brevity, not all possible combinations of the technical features, in the above-mentioned embodiments are described. However, it should be considered that the technical features are included in the scope of the specification provided that there is no contradiction in the combinations thereof.

It should be understood that the above-mentioned embodiments are only intended to illustrate rather than to limit the technical solutions of the present invention. For a person skilled in the art, the technical solutions described in the above-mentioned embodiments can be modified or some technical features therein can be replaced equivalently; and all these modifications and replacements should fall within the protection scope of the appended claims of the present invention.

What is claimed is:

1. An assembled annular light supplement lamp, comprising a first splicer and a second splicer that are spliced to form a ring, and a fixed seat connected to the first splicer, wherein the first splicer is provided with a first lamp panel and a mounting groove, and a power supply component and a control component that are electrically connected to the first lamp panel are arranged in the mounting groove; the second splicer is provided with a second lamp panel; both ends of the first splicer and the second splicer are provided with a first end face and a second end face respectively, and the first end face is in plug-in connection with the adjacent second end face.

2. The assembled annular light supplement lamp according to claim 1, wherein the first end face is provided with a convex step on which a first guide pin and a first contact spring are arranged, the second end face is provided with a groove matched with the convex step, and the groove is provided with a first slot in close fit with the first guide pin and, a second contact spring; the first contact spring and the second contact spring are electrically connected to the corresponding lamp panels respectively, and the first guide pin is inserted into the first slot to connect the first contact spring and the second contact spring.

3. The assembled annular light supplement lamp according to claim 2, wherein the first end face is further provided with a snap, and the second end face is provided with a snap joint matched with the snap.

4. The assembled annular light supplement lamp according to claim 3, wherein the first end face is further provided with a first flange on, the side away from the snap, and the second end face is provided with an avoidance groove matched with the flange on the side away from the snap joint.

5. The assembled annular light supplement lamp according to claim 4, wherein the first splicer comprises a first base plate and a first cover plate, the first lamp panel is arranged in a first cavity formed by the first base plate and the first cover plate, and the first contact spring is connected to the first lamp panel through a spring press block; and the first mounting groove is connected to the first base plate.

6. The assembled annular light supplement lamp according, to claim 5, wherein the first mounting groove comprises a mounting cavity wall integrally arranged with the first base plate and a rear cover plate connected to the mounting cavity wall, the upper end of the mounting cavity wall is provided with a second slot, and the upper end of the rear cover plate is correspondingly provided with a second guide pin matched with the second slot.

7. The assembled annular light supplement lamp according to claim 6, wherein one or a plurality of second splicers are provided.

8. The assembled annular light supplement lamp according to claim 4, wherein the first guide pin comprises a column and ribs arranged on both sides of the column, and the width of the ribs is smaller than the diameter of the column.

9. The assembled annular light supplement lamp according to claim 2, wherein the second splicer comprises a second base plate and a second cover plate, the second lamp panel is arranged in a second cavity formed by the second base plate and the second cover plate, several air vents recessed toward one side of the second cavity are arranged on the second base plate, and side walls of the air vents are provided with through holes to communicate with the second cavity.

10. The assembled annular light supplement lamp according to claim 2, wherein a rotary seat for adjusting the angle of the fixed seat is removably connected to the fixed seat, the rotary seat is locked with the fixed seat through a first locking member, a sleeve is arranged at the other end of the rotary seat, and a second locking member for limiting the sleeve is arranged on the rotary seat.

* * * * *